United States Patent [19]

Ando et al.

[11] 4,349,766

[45] Sep. 14, 1982

[54] DIRECTLY HEATED CATHODE FOR ELECTRON TUBE

[75] Inventors: Hisashi Ando; Ko Soeno; Hiroshi Sakamoto, all of Hitachi; Akira Misumi, Mobara; Hiroshi Fukushima, Chiba, all of Japan

[73] Assignee: Hitachi, Ltd., Tokyo, Japan

[21] Appl. No.: 143,898

[22] Filed: Apr. 25, 1980

[30] Foreign Application Priority Data

Apr. 28, 1979 [JP] Japan ..... 54/52770

[51] Int. Cl.[3] ..... H01J 1/14; H01J 19/06; H01K 1/04

[52] U.S. Cl. ..... 313/346 R; 252/513; 252/515; 313/345; 29/25.17

[58] Field of Search ..... 313/341, 345, 346; 252/513, 515, 519; 29/25.17

[56] References Cited

U.S. PATENT DOCUMENTS

| | | | |
|---|---|---|---|
| 2,843,517 | 7/1958 | Kerstetter et al. | 313/346 |
| 3,351,486 | 11/1967 | Buescher et al. | 313/346 X |
| 3,374,385 | 3/1968 | Lattimer | 313/346 X |
| 3,541,382 | 11/1970 | Takanaski et al. | 313/346 X |
| 4,208,208 | 6/1980 | Misumi et al. | 313/346 R |
| 4,220,891 | 9/1980 | Ando et al. | 313/346 R |
| 4,260,665 | 4/1981 | Aida et al. | 313/346 R |
| 4,279,784 | 7/1981 | Misumi et al. | 313/346 |
| 4,310,777 | 1/1982 | Fukushima et al. | 313/346 |

*Primary Examiner*—Saxfield Chatmon, Jr.
*Attorney, Agent, or Firm*—Craig and Antonelli

[57] ABSTRACT

A directly heated cathode for electron tube having a stable electron emission characteristic is provided. The cathode comprises a base metal of Ni-W alloy consisting essentially of 20–30% by weight of tungsten, the balance being nickel and incidental impurities, said alloy being free from a reducing agent, and a layer of thermoelectron emission oxides laid directly and baked onto the flat part at the front side of the base metal. The layer of thermoelectron emission oxides is in direct contact with the flat part of the base metal.

12 Claims, 9 Drawing Figures

SCALE : x 5000

SCALE : x 5000

DIRECTLY HEATED CATHODE FOR ELECTRON TUBE

This invention relates to a directly heated cathode for electron tube, and more particularly to a novel directly heated cathode for electron tube, which comprises a cathode base metal of tungsten-nickel alloy and a thermoelectron emission oxide layer directly formed on a flat part of the base metal without using a binder material therebetween.

Recently, in the field of camera tube, various cathode-ray tubes, television picture tubes, etc., development of the so called quick start electron tubes capable of being put in operation within about one second after an electron source switch is turned on have been in demand, and directly heated cathodes have been proposed in place of the conventional indirectly heated cathodes. The directly heated cathode is comprised of a layer of thermoelectron emission oxides such as alkaline earth metal oxides formed through a binder layer on a flat part of a cathode base metal comprising a heat-resistant alloy, where thermoelectrons are made to be emitted from the oxides by directly passing an electric current between the flat part and leg parts of the base metal.

Main characteristics required for the cathode base metal are given as follows:

(a) Sufficient and stable electron emission can be effected for a long period of time.

(b) A fluctuation in cut-off voltage must be small.

(c) No peeling of the alkaline earth metal oxides (Ba.Sr.Ca)O must not be brought about.

(d) Since the base metal is a resistor, a specific resistance at the normal temperature must be more than 50 $\mu\Omega$-cm and a specific resistance at 800° C. must be more than 80 $\mu\Omega$-cm.

(e) Strength at an elevated temperature such as 800°-900° C. must be more than 15 kg/mm$^2$.

Directly-heated cathode using base metals of tungsten-nickel-reducing agent alloy are proposed in Japanese Patent Publication No. 21008/69, Japanese Laid-open Patent Applications Nos. 57771/77 and 108770/77 and U.S. Pat. Nos. 4,079,164 and 4,081,713 from the foregoing viewpoints.

Japanese Patent Publication No. 21008/69 discloses addition of an impurity amount of zirconium, silicon, aluminum, etc. as a reducing agent to a tungsten-nickel alloy, but the proposed base metal has no function to maintain electron emission over a longer period of time.

Japanese Laid-open Patent Application No. 57771/77 discloses a comparative example of using a cathode base metal of an alloy containing 0.4% zirconium, applying nickel powders as a binder material onto the entire surface of the flat part, followed by baking, and forming an oxide layer on the nickel layer. However, the thermoelectron emission characteristics of the cathode has various problems.

Japanese Laid-open Patent Application No. 108770/77 discloses a cathode prepared by forming a nickel plated layer on the entire surface of the flat part or the entire base metal, followed by heat diffusion, and then forming a layer of nickel powders. However, the plated layer has no good effect upon the thermoelectron emission characteristics. That is, such a diffusion layer is not required for the thermoelectron emission characteristics.

U.S. Pat. No. 4,079,164 discloses a base metal for directly heated cathode, comprising an alloy of 20-30% by weight of tungsten and 0.05-5% by weight of zirconium, the balance being nickel, but the base metal has problems in the stability of electron emission characteristics and cut-off voltage.

U.S. Pat. No. 4,081,713 discloses deposition of nickel powders on both sides of the flat part of base metal to balance a thermal deformation, but the base metal still has a possibility of a wave-like deformation.

Another directly heated cathode for electron tube has been recently proposed in U.S. Patent Application Ser. No. 25582, now U.S. Pat. No. 4,220,891, which comprises a base metal of an alloy consisting essentially of 20-30% by weight of tungsten and a trace amount to 0.25% by weight of zirconium, the balance being nickel, binder dots of metallic nickel powders distributed on a flat part at the front side of the base metal, and a layer of thermoelectron emission oxides laid on the flat part at the front side of the base metal, the layer of thermoelectron emission oxides being in direct contact with the flat part through clearances among the binder dots of metallic nickel powders.

Still another directly heated cathode for electron tube has been disclosed in German Laid-open Patent Application (DOS) No. 2842661, which comprises a base metal of Ni-based alloy containing tungsten in solid solution approximately up to its solubility limit and a very small amount of a reducing impurity, and an electron emitting material coating consisting of alkaline earth metal oxide on the base metal, and a film of platinum or rhenium between the base metal and the electron emitting material coating.

A typical structure of the so far proposed directly heated cathode for electron tube, as described above will be explained in detail, referring to a drawing.

Figure 6A:
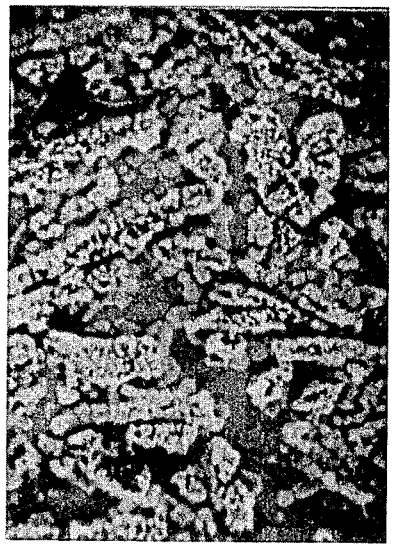

FIG. 6*a* is an electron-microscopic picture (×5,000) showing the state of thermoelectron emission oxides deposited on the cathode base metal (Ni-28% W) of the present invention 2,000 hours after the application in an electron tube.

Figure 6B:
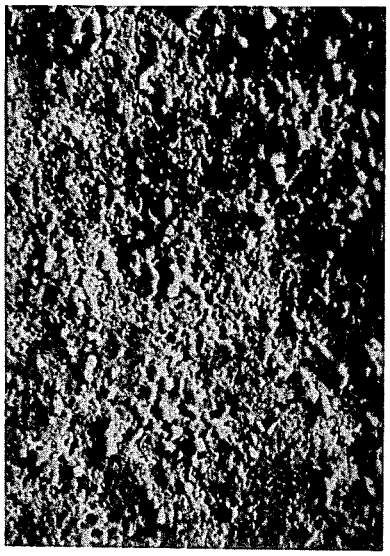

FIG. 6*b* is that of the state of thermoelectron emission oxides deposited on the conventional cathode base metal (Ni-28% W-0.45% Zr) 2,000 hours after the application in an electron tube.

Figure 7:
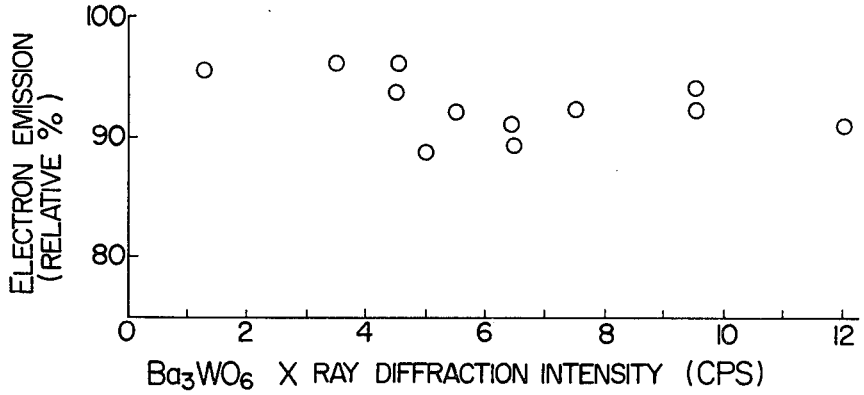

FIG. 7 is a diagram showing relationships between electron emission (relative %) and $Ba_3WO_6$ X ray diffraction intensity (CPS) according to the cathode of the present invention.

Figure 8:
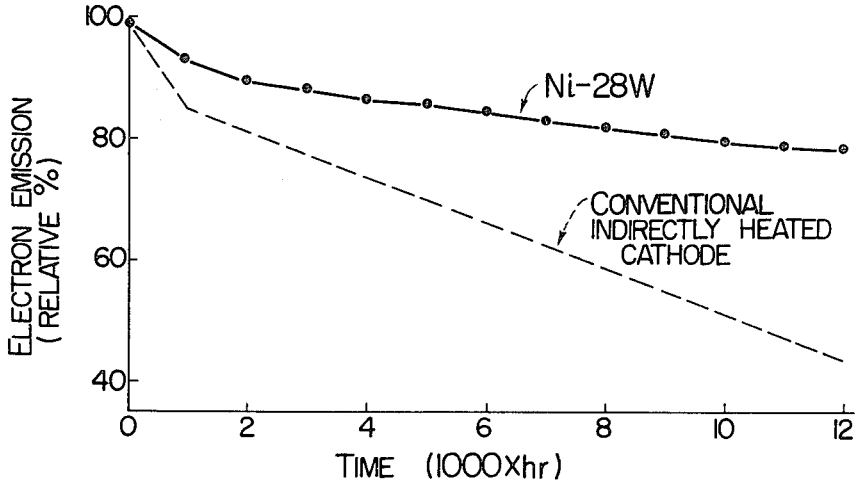

FIG. 8 is a diagram showing relationships between electron emission (relative %) and application time (1,000 hr) of the present cathode and the conventional indirectly heated cathode.

Figure 1:
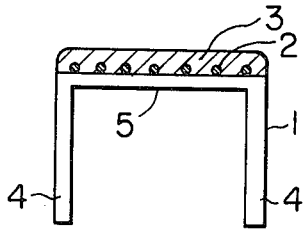
FIG. 1 is a schematic cross-sectional view of a structure of the directly heated cathode so far proposed.

In FIG. 1, a typical structure of the so far proposed directly heated cathode is schematically shown. Numeral 1 is a cathode base metal capable of generating heat when a current is directly passed through the cathode base metal. Since a cathode base metal must have a high temperature strength, an appropriate electric resistance, and an easy workability as well as an excellent cold rolling workability, alloys containing nickel, tungsten, and a reducing agent such as Mg, Si, Al, Zr, Ta, etc. have been so far used. A few mg/cm$^2$ of a binder such as nickel powder or powder comprising nickel as the main component is deposited on flat part 5 of base metal 1 and sintered in vacuum or in a reducing atmosphere, whereby aggregated nickel powder 2 or powder comprising nickel as the main component is distributed on the flat part in a discrete state. The powder 2 roughening the surface of the flat part 5 can firmly fix thermoelectron emission oxide layer 3, for example, (Ba, Sr, Ca) 0 to the flat part 5 of cathode base metal 1.

The powder 2 is indispensable for the directly heated cathode of such structure as described above, because omission of the powder 2 gives rise to formation of reaction products between the reducing agent contained in the base metal and the thermoelectron emission oxides, for example, formation of $BaZrO_3$ between a Ni-W-Zr alloy as the base metal 1 and alkaline earth metal oxides as the thermoelectron emission oxides 3. $BaZrO_3$ itself is weak in the strength of fixing the thermoelectron emission oxides 3, and thus the thermoelectron emission oxides 3 are liable to be peeled off during the use as the cathode, resulting in the deterioration of thermoelectron emission.

That is, the powder 2 is indispensable for the above-mentioned structure, but uniform distribution of the powder 2 on the flat part of base metal is difficult to attain by depositing the powder onto the base metal by spraying, followed by sintering. In some cases, cathodes having the powder on the flat part of base metal with uneven thickness or uneven coverage are produced. In the case of a cathode having the nickel powder with much coverage on the flat part of base metal, reaction between the base metal and the alkaline earth metal oxides proceeds less, lowering the thermoelectron emission. On the other hand, a cathode having the nickel powder with less coverage has a fluctuation in the thermoelectron emission characteristics such as an increase in the thermoelectron emission, etc.

Further, it has been found that in the case of the nickel powder as the binder, the nickel powder deposited between the base metal and the thermoelectron emission oxides is diffused and permeated through the base metal during the use as the cathode, leaving complete voids at the nickel powder positions, and the thermoelectron emission oxides are made readily peelable thereby.

Direct deposition and baking of the thermoelectron emission oxides onto the conventional cathode base metal of nickel-tungsten-reducing agent has been so far presumed as unpreferable, because, for example, in the case of Zr as the reducing agent, the notorious $BaZrO_3$ is formed between the cathode base metal and the thermoelectron emission oxides, and thus the binder such as the nickel powder has been deemed indispensable and has been provided as a layer or in a discrete state between the cathode base metal and the thermoelectron emission oxides.

However, as a result of extensive studies, the present inventors have found that, when a cathode base metal consisting essentially of nickel and tungsten is used, the thermoelectron emission oxides can be directly deposited and baked onto the cathode base metal without providing any binder such as nickel powders between the base metal and the thermoelectron emission oxides and the resulting cathode can be used for a prolonged period of time without any substantial peeling of the thermoelectron emission oxides but with a stable thermoelectron emission. In the case of the cathode base metal consisting essentially of nickel and tungsten, it can be presumed that the tungsten in the base metal reacts with barium in the thermoelectron emission oxides by baking to form perovskite type needle-like grains of $Ba_3WO_6$ on the base metal, and the $Ba_3WO_6$ grains reinforce the fixation of the thermoelectron emission oxides to the base metal.

Furthermore, the present inventors have found that, when the cathode base metal consisting essentially of nickel and tungsten is coated with platinum on the entire surface of the flat part of the base metal, and the thermoelectron emission oxides are deposited and baked onto the platinum-coated base metal, excess formation of $Ba_3WO_6$ can be prevented and a more improved electron emission characteristic can be obtained.

An object of the present invention is to provide a directly heated cathode for electron tube capable of performing stable thermoelectron emission for a prolonged period of time. The present directly heated cathode is characterized by comprising a cathode base metal free from any reducing metal, which consists essentially of 20 to 30% by weight of tungsten, the balance being nickel and incidential impurities, said alloy being free from a reducing agent, and a thermoelectron emission oxide layer laid directly and baked onto the flat part of the cathode base metal without providing any binder between the base metal and the thermoelectron emission oxide layer, the interface between said layer and said base metal consisting of composite oxides of the alkali earth metals and tungsten, such as perovskite structure $Ba_3WO_6$. The binder means nickel powder, nickel-cobalt powder, etc., which are distributed on the flat part of the base metal to fix the thermoelectron emission oxides to the flat part, and correspond to numeral 2 in FIG. 1.

The directly heated cathode according to the present invention has such effects that the thermoelectron emission oxides are hardly peelable even after the use for a long period of time with high thermoelectron emission.

The directly heated cathode according to the present invention will be described in detail below, referring to the drawings and embodiments.

Figure 2:
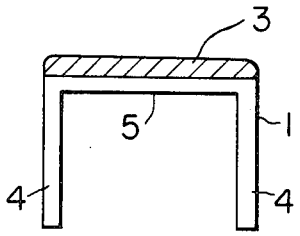
FIG. 2 is a schematic cross-sectional view of a structure of the directly heated cathode according to the present invention.

FIG. 2 is a side view showing the structure of directly heated cathode according to the present invention, where the cathode base metal is comprised of flat part 5 and leg parts 4. The cathode base metal consists essentially of 20 to 30% by weight of tungsten, the balance being nickel, and may include incidential impurities, but is completely free from the so called reducing agent so far used, such as Mg, Si, Al, Zr, and Ta.

The cathode base metal can be prepared by sintering raw material metal powders of Ni and W with a high purity or alloy powder of Ni and W, rolling the sintered metal to a sheet, blanking the sheet to a desired form, and shaping the blanked sheet into a cathode configuration.

The reasons for selecting the composition range of the cathode base metal as mentioned above are as follows: When the tungsten content is less than 20% by weight, the specific resistance of the alloy at the normal temperature will be less than 50 μΩ-cm, and the specific resistance at 800° C. will be less than 80 μΩ-cm. Thus, the function as a heater is not sufficient, and the quick start of the directly heated cathode is retarded. When the tungsten content is also less than 20% by weight, the strength of the alloy at an elevated temperature, for example, 800° C. will be less than 15 kg/mm$^2$, and the cathode will be deformed at the elevated temperature, making the life of the cathode shorter.

When the tungsten content exceeds 30% on the other hand, an intermetallic compound of nickel and tungsten is formed, and cracks are developed at the cold rolling even in only a few percent reduction ratio, though the specific resistance and the high temperature strength are satisfied. That is, a satisfactory sheet cannot be obtained. A preferable tungsten content is 26–29% by weight.

Figure 3:
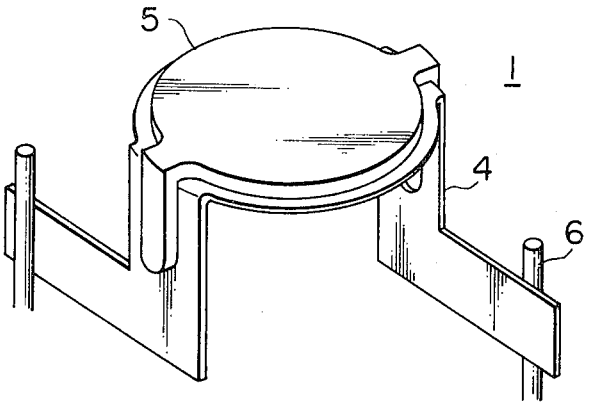
FIG. 3 is a schematic view of a configuration of cathode base metal according to one embodiment in current practice.

FIG. 3 shows a configuration of a cathode base metal 1 according to one embodiment in the current practice, where the flat part 5 of the cathode base metal is shaped into a cup form to increase the rigidity and prevent deformation of the flat part 5 due to the oxidation of alkaline earth metal carbonates, (Ba, Sr, Ca)$CO_3$ and the resulting reaction products of perovskite structure $Ba_3WO_6$, etc. Leg parts 4 are in an L-shaped structure, and the cup structure is extended down from the flat part along the centers of both leg parts to give rigidity also to the leg parts. Electrodes 6 are provided at the ends of both L-shaped leg parts. It is preferable for the prevention of deformation to use the present cathode as shaped in the configuration of FIG. 3.

One embodiment of preparing the present cathode will be given below.

The present tungsten-nickel alloy for the cathode base metal can be prepared preferably by powder metallurgy. In the powder metallurgy, vacuum sintering must be carried out at 1,350° C., for example, in an atmosphere kept in vacuum of about $5\times10^{-5}$ torr. to prevent oxidation of the material at sintering.

The resulting sintered material is then subjected to at least one cold rolling and at least one vacuum annealing to prepare a sheet.

The sheet having a thickness of, for example, 40 μm, prepared by said cold rolling and vacuum annealing is blanked to obtain base metal pieces of desired configuration. Then, alkaline earth metal carbonates (Ba.Sr.Ca)$CO_3$ are deposited on the base metal piece by spraying, and the resulting cathode piece is inserted and sealed in an electron tube. The base metal piece is heated by direct current passage therethrough while exhausting the electron tube to a vacuum, whereby (Ba.Sr.Ca)$CO_3$ is converted to (Ba.Sr.Ca)O, and a directly heated cathode as illustrated in FIG. 2 can be prepared.

Figure 4:
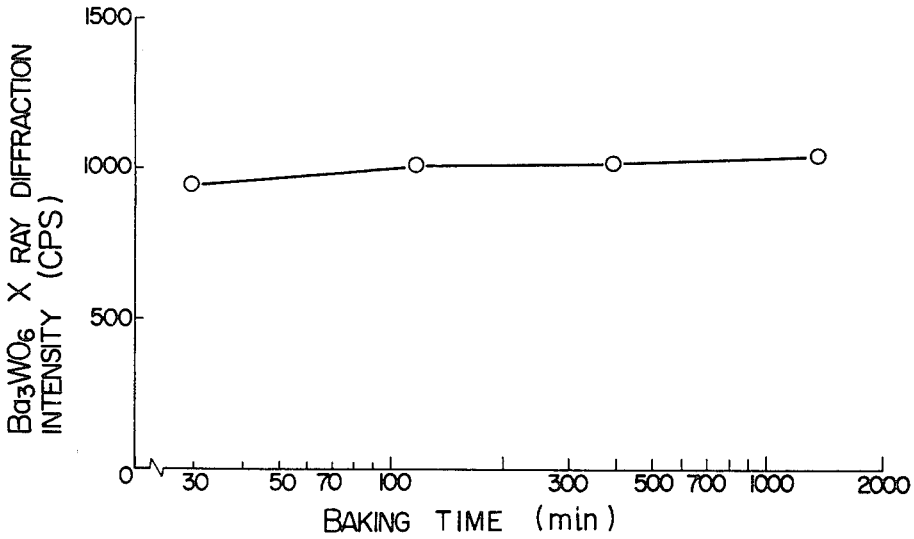
FIG. 4 is a diagram showing relationships between $Ba_3WO_6$ X ray diffraction intensity (CPS) of the cathode base metal and baking time (min.).
Figure 5:
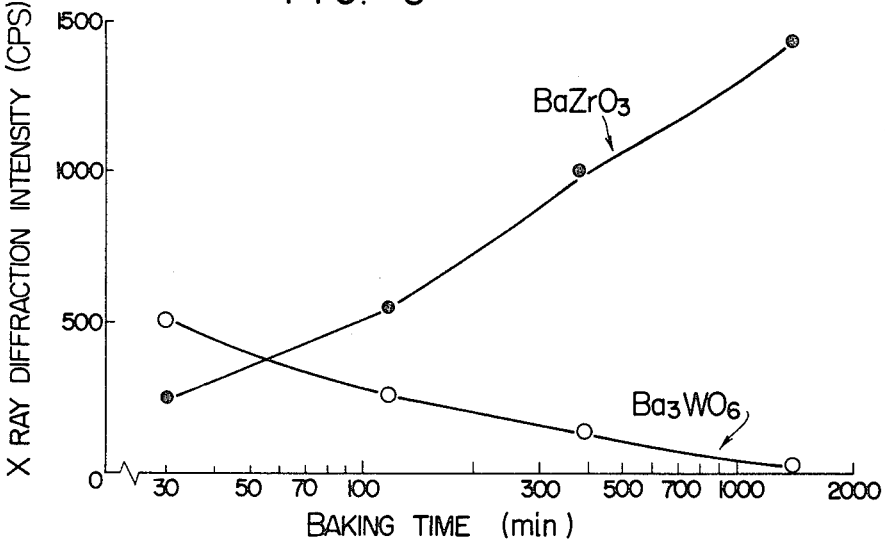
FIG. 5 is a diagram showing relationships between $BaZrO_3$ and $Ba_3WO_6$ X ray diffraction intensities (CPS) of the conventional cathode base metal and baking time (min.).

FIG. 4 shows relationships between the amount of reaction products at the boundary surface between a base metal and thermoelectron emission oxides and the baking time of the oxides when (Ba, Sr, Ca)O is baked onto a base metal (Ni-28 wt. % W), and FIG. 5 shows relationships between the amount of reaction products and the baking time of the oxides when the oxides are baked onto the conventional base metal (Ni-28 wt.% W-0.4 wt.% Zr). The test pieces used in FIGS. 4 and 5 were sheets, 20 mm×20 mm, and (Ba, Sr, Ca)O were directly baked onto the sheets by heating at 1,000° C. for 30 to 1,500 minutes.

The determination of the amount of reaction products was made by measuring a peak intensity of the strongest diffraction beam of the reaction products under the following X ray diffraction conditions:

| X-ray diffraction conditions: | |
|---|---|
| Target | Copper |
| Tube voltage | 45 kV |
| Tube current | 40 mA |
| Slit system | 1°-1°-0.3 mm |
| Time constant | 5 sec. |
| Scanning speed | ½°/min. |

In the case of Ni-W alloy, the reaction product was only $Ba_3WO_6$, whereas in the case of Ni-W-Zr alloy $BaZrO_3$ was formed besides $Ba_3WO_6$.

As is obvious from FIG. 4, $Ba_3WO_6$ in the Ni-W alloy is stable even with a prolonged baking time without a considerable fluctuation in the amount of $Ba_3WO_6$. On the other hand, in the case of the Ni-W-Zr alloy, the amount of $Ba_3WO_6$ is decreased and that of $BaZrO_3$ is increased with a prolonged baking time, as is evident from FIG. 5. That is, it is seen that $Ba_3WO_6$ is decomposed by Zr in the base metal.

After the baking, the peelability of (Ba, Sr, Ca)O from the base metals was investigated by exposing the baked test pieces to the atmosphere. It was found that in the case of the Ni-W-Zr alloy, (Ba, Sr, Ca)O was not substantially peeled off for the baking time of 30 minutes because of the presence of much $Ba_3WO_6$, whereas the thermoelectron emission oxides were peeled off from the entire surface of the base metal for the baking time of 120 minutes or more where the formation of $BaZrO_3$ is dominant, even by exposure only for a few minutes. On the other hand, in the case of the Ni-W alloy (28 wt.% W) the thermoelectron emission oxides were firmly fixed and were not peeled off. The oxides were only peeled by dipping the test piece in ethyl alcohol and vigorously rubbing the dipped test piece with cotton gauze.

FIG. 6*a* and FIG. 6*b* are electron microscope pictures (magnification: 5,000) of the surfaces of cathode base metals, prepared by depositing and baking thermoelectron emission oxides directly onto cathode base metal of Ni-28 wt.% W (the present invention) and that of Ni-28 wt.% W-0.45 wt.% Zr (comparative) without using any binder Ni powder, respectively, and used as cathodes in electron tubes for 2,000 hours, then dipped in ethyl alcohol, and rubbed by cotton gauze to remove the thermoelectron emission oxides.

As is obvious from FIG. 6*a*, needle-like perovskite structure $Ba_3WO_6$ grains are firmly fixed to the base metal surface, whereas very less grains are fixed to the comparative base metal, and a flat base metal surface is observable, as obvious from FIG. 6*b*, and thus it is seen that the thermoelectron emission oxides are readily peelable. That is, in the case of the Ni-W base metal free from the so-called reducing agent, (Ba, Sr, Ca)O can be firmly fixed to the base metal, and thus the binder Ni powder indispensable for fixation of (Ba, Sr, Ca)O in the case of the Ni-W-Zr base metal is not necessary to provide.

FIG. 7 shows relationships between X ray diffraction intensity (CPS) of $Ba_3WO_6$ on the flat part of the present cathode and electron emission (relative %) 2,000 to 8,000 hours after used at 730° C. The test piece used had the structure shown in FIG. 2 and a flat part having a diameter of 1.2 mm, and the cathode base metal was an alloy of Ni-28 wt.% W. It is obvious from FIG. 7 that there is no clear correlation between the amount of $Ba_3WO_6$ and the electron emission, but a stable electron emission can be constantly obtained.

The present inventors measured changes in electron emission with time of the present cathode of the alloy of Ni-28 wt.% W. The results are shown in FIG. 8, where the time used as the cathode is plotted on the abscissa and the electron emission (relative %) is plotted on the ordinate. In FIG. 8, the dotted line shows the change in electron emission with time of the ordinary indirectly heated cathode. It is practical to presume that a given directly heated cathode is satisfactory if the level of electron emission of the directly heated cathode is equal or superior to that of an indirectly heated cathode. In the present invention, the cathode of the alloy of Ni-28 wt.% W has a better electron emission characteristic as shown in FIG. 8, where the use temperature is 730° C.

For comparison, a cathode was prepared by depositing thermoelectron emission oxides on a cathode base metal of Ni-28 wt.% W-0.45% Zr as a reducing agent through a binder Ni powder therebetween, and tested for comparison with the present cathode.

The comparative cathode was prepared in the following manner.

The tungsten-zirconium-nickel alloy was prepared by powder metallurgy through vacuum sintering at 1,350° C., that is, in an atmosphere kept in vacuum of about $5\times10^{-5}$ torr.

The resulting sintered material was then subjected to one cold rolling and one vacuum annealing to prepare a sheet.

The sheet having a thickness of 40 μm, prepared by said cold rolling and vacuum annealing was blanked and shaped to obtain base metal pieces of the configuration shown in FIG. 3. Nickel powders having particle sizes of 2–7 μm were deposited dot-wise on the flat part of the base metal piece (area: 1 $mm^2$) at a rate of about 1.5 $mg/cm^2$ by spraying, and vacuum-baked at 900° C. and $5\times10^{-5}$ torr for 30 minutes. After cooling, alkaline earth metal carbonates $(Ba.Sr.Ca)CO_3$ were deposited on the base metal piece by spraying, and the resulting cathode piece was inserted and sealed in an electron tube. The base metal piece was heated by direct current passage therethrough while exhausting the electron tube to a vacuum, whereby $(Ba.Sr.Ca)CO_3$ was converted to (Ba.Sr.Ca)O.

In the case of the comparative cathode, the Ni powder provided between the cathode base metal and the thermoelectron emission oxides was diffused and permeated into the base metal 2,000 hours after the start of use, leaving voids at the Ni powder positions. Thus, the thermoelectron emission oxides were in a suspended state and had a high risk of peeling. On the other hand, in the case of the present cathode, there was no risk of peeling of the thermoelectron emission oxides even 2,000 hours after the start of use, and the electron emission was stable over a long period of time, as shown in FIG. 8. In the present invention, a step of depositing the binder Ni powder can be omitted, and thus a merit of process simplification can be attained.

According to another embodiment of the present invention, platinum is coated by vapor deposition to a thickness of 1,000 to 2,000 Å onto the flat part of the present cathode base metal of Ni-W prepared by sintering by powder metallurgy, annealing in vacuum, cold rolling and blanking the resulting sheet having a thickness of 40 μm to a desired configuration, but before the deposition of thermoelectron emission oxides thereon, and then the alkaline earth metal carbonates are sprayed onto the entire surface of the platinum coating on the flat plate to a thickness of 70 μm, and baked. The resulting cathode with the platinum coating has an electron emission characteristic equal to that of the cathode without the platinum coating, but has a more improved electron emission characteristic for a prolonged period of time since excess formation of $Ba_3WO_6$ can be prevented by the platinum coating.

As described above, $Ba_3WO_6$ is formed at the boundary surface between the base metal and the thermoelectron emission oxides when the thermoelectron emission oxides are baked directly onto the cathode base metal consisting essentially of 20 to 30% by weight of tungsten, the balance being nickel, and $Ba_3WO_6$ firmly fixes the thermoelectron emission oxides. Thus, a high and stable electron emission characteristic can be maintained for a long period of time. Furthermore, when the present base metal is coated with platinum, and the thermoelectron emission oxides are baked on the platinum-coated base metal, excess formation of $Ba_3WO_6$ can be prevented, and the electron emission characteristics can be further improved for a prolonged period of time.

What is claimed is:

1. A directly heated cathode for an electron tube, which comprises a base metal of Ni-W alloy consisting essentially of 20–30% by weight of tungsten, and the balance being nickel and incidental impurities, said alloy being free from a reducing agent, and a layer consisting essentially of thermoelectron emission oxides laid directly and baked onto a flat part at a front side of the base metal, the layer of thermoelectron emission oxides being in direct contact with the flat part of the base metal and $Ba_3WO_6$ being predominant at a boundary surface between the metal base and the layer of thermoelectron emission oxides.

2. A directly heated cathode for an electron tube, which comprises a base metal of Ni-W alloy consisting essentially of 20–30% by weight of tungsten, and the balance being nickel and incidental impurities, said alloy being free from a reducing agent, a flat part of the base metal being coated with platinum, and a layer consisting essentially of thermoelectron emission oxides laid directly and baked onto the platinum coated flat part of the base metal, the layer of thermoelectron emission oxides being in direct contact with the flat part of the base metal and $Ba_3WO_6$ being predominant at a boundary surface between the metal base and the layer of thermoelectron emission oxides.

3. A directly heated cathode for an electron tube according to claim 1 or 2, wherein the tungsten content is 26–29% by weight.

4. A directly heated cathode for an electron tube according to claim 3, wherein the tungsten content is about 28% by weight.

5. A directly heated cathode for an electron tube according to claim 1 or 2, wherein the thermoelectron emission oxides are (Ba, Sr, Ca)O.

6. A directly heated cathode for an electron tube according to claim 1 or 2, wherein the base metal is in a cup form configuration.

7. A directly heated cathode for an electron tube, which comprises a base plate made of an alloy consisting essentially of 20 to 30% by weight of tungsten, and the balance being nickel and incidental impurities, said alloy being free from reducing agent, and a layer of an electron emission material consisting essentially of alkaline earth metal oxides being directly adhered to the surface of said base plate, the interface between said layer and said base plate consisting of composite oxides of the alkaline earth metals and tungsten, with $Ba_3WO_6$ being predominant at said interface.

8. A directly heated cathode for electron tube, according to claim 1, or 7, wherein the cathode is prepared by sintering in a vacuum a mixture of 20 to 30% by weight of tungsten powders and 70 to 80% by weight of nickel powders and incidental impurities, free from a reducing agent, or a powder of an alloy of 20 to 30% by weight of tungsten, the balance being nickel and incidental impurities, the alloy being free from a reducing agent, conducting at least one rolling and annealing in vacuum of the resulting sintered product into a sheet, blanking the sheet into a base metal of desired configuration, directly depositing an alkaline earth metal carbonate onto the flat part of the base metal, placing the alkaline earth metal carbonate-deposited base metal into an electron tube, and heating the base metal by direct passage of current through the base metal while exhausting a gas from the electron tube in vacuum, thereby converting the alkaline earth metal carbonate to alkaline earth metal oxide.

9. A directly heated cathode for electron tube according to claim 2, wherein the cathode is prepared by sintering in a vacuum a mixture of 20 to 30% by weight of tungsten powders and 70 to 80% by weight of nickel powders and incidental impurities, free from a reducing agent, or a powder of an alloy of 20 to 30% by weight of tungsten, the balance being nickel and incidental impurities, the alloy being free from a reducing agent, conducting at least one rolling and annealing in vacuum of the resulting sintered product into a sheet, blanking the sheet into a base metal of desired configuration, vapor-depositing platinum onto the flat part of the base metal, then depositing an alkaline earth metal carbonate onto the platinum layer on the flat part of the base metal, placing the alkaline earth metal carbonate-deposited base metal into an electron tube, and heating the base metal by direct passage of current through the base metal while exhausting a gas from the electron tube in vacuum, thereby converting the alkaline earth metal carbonate to alkaline earth metal oxide.

10. A directly heated cathode for electron tube according to claim 8, or 9, wherein the sintering is carried out in a vacuum of about $5\times10^{-5}$ Torr.

11. A directly heated cathode for electron tube according to claim 8, or 9, wherein the alkaline earth metal carbonate is $(Ba, Sr, Ca)CO_3$.

12. A directly heated cathode for electron tube according to claim 9, wherein the platinum layer has a thickness of 1,000 Å–2,000 Å.

* * * * *